United States Patent [19]

Warrick

[11] Patent Number: 4,823,861

[45] Date of Patent: Apr. 25, 1989

[54] FIRE DETECTION DEVICE FOR REGENERATIVE AIR HEATER

[75] Inventor: Richard J. Warrick, North Canton, Ohio

[73] Assignee: The Babcock & Wilcox Company, New Orleans, La.

[21] Appl. No.: 241,162

[22] Filed: Sep. 6, 1988

[51] Int. Cl.[4] ..... F28G 13/00

[52] U.S. Cl. ..... 165/5; 165/11.1

[58] Field of Search ..... 165/5, 11.1

[56] References Cited

U.S. PATENT DOCUMENTS

| | | | |
|---|---|---|---|
| 150,566 | 9/1874 | Guest . | |
| 440,567 | 9/1890 | Hawke . | |
| 2,150,142 | 3/1939 | Brace . | |
| 3,166,119 | 1/1965 | Bellows | 165/9 |
| 3,183,961 | 5/1965 | Brandt | 165/5 |
| 3,516,082 | 6/1970 | Cooper . | |
| 3,730,259 | 5/1973 | Wixson et al. | 165/5 |
| 3,731,247 | 5/1973 | Levinn . | |
| 3,861,458 | 1/1975 | Ostrander et al. | 165/5 |
| 4,019,567 | 4/1977 | Wixson et al. | 165/5 |
| 4,022,270 | 5/1977 | Stockman | 165/5 |
| 4,099,165 | 7/1978 | Botnen | 165/5 |
| 4,176,618 | 12/1979 | Hubert . | |
| 4,192,372 | 3/1980 | Bellows | 165/5 |
| 4,356,478 | 10/1982 | Muggli et al. . | |
| 4,383,572 | 5/1983 | Bellows | 165/5 |

FOREIGN PATENT DOCUMENTS

| | | | |
|---|---|---|---|
| 1126466 | 9/1968 | United Kingdom | 165/5 |

*Primary Examiner*—Albert W. Davis, Jr.
*Attorney, Agent, or Firm*—Vytas R. Matas; Robert J. Edwards; Eric Marich

[57] ABSTRACT

A regenerative air heater is comprised of a matrix of heating surface elements contained in a compartmented housing with heat transfer being effected by alternately exposing the heating surface elements to hot gas and cooler air, thereby heating the exiting air stream. Unburned products of combustion present in the gas may collect on the heating surface and, under certain operating conditions, ignite spontaneously in one or more local areas. In some instances, the local combustion can become severe enough to cause the heat transfer surface itself to burn, seriously damaging the heat exchanger. An elongated expansion element, made of a material having a high coefficient, of thermal expansion relative to the compartment structure, is used to sense the presence of a hot spot in any air heater compartment. The resulting thermal initiated expansion of the element activates a device to indicate the presence of a hot spot in the heat exchanger.

17 Claims, 3 Drawing Sheets

FIRE DETECTION DEVICE FOR REGENERATIVE AIR HEATER

BACKGROUND OF THE INVENTION

The present invention relates in general to regenerative air heaters, and, in particular, to a new and useful fire or hot spot detector for regenerative air heaters.

A regenerative air heater comprises a housing containing a matrix for receiving and giving up heat. Ducts are connected to the housing for supplying heating gas to the matrix for heating the matrix and for supplying air for being heated by the matrix.

Combustible deposits can accumulate on heat transfer surfaces and elements of the matrix in a regenerative air heater. Under certain conditions, these deposits can ignite causing considerable damage to the equipment. This results in costly repairs and extensive boiler outages.

Methods are known for detecting fires or "hot spots" that lead to fires in regenerative air heaters.

U.S. Pat. No. 4,099,165 discloses the use of a thermocouple grid for fire detection in regenerative air preheaters. Infra-red sensors are disclosed in U.S. Pat. No. 3,730,259. Another detection apparatus is available from Fenwal, Inc. of Ashland Mass., which utilizes concentric conductors containing a eutectic salt there between, which liquifies when being exposed to a local "hot spot". The salt is conductive in its liquid state which establishes electrical contact between the conductors. This contact is used to trigger an alarm.

All known techniques for detecting fires or hot spots which lead to fires in regenerative air heaters suffer from various drawbacks.

Thermocouples must be located in the air or gas stream, some distance from the matrix or housing of the heater. This makes thermocouples insensitive as the bulk stream flow dilutes local hot spots.

Infra-red sensors utilize lenses which may become dirty, rendering the device insensitive. These sensors also depend on movement to obtain full coverage of the heat exchange area in the matrix.

Concentric conductors require the use of slip rings or other means for transmitting a signal from rotating matrix heaters.

A need thus remains for a robust hot spot detecting device which is reliable while being responsive to hot spots in the matrix regardless of their location.

SUMMARY OF THE INVENTION

The present invention comprises a hot spot detector for a regenerative air heater which utilizes an elongated expansion element located in or near the heating surfaces of the heater matrix. The element comprises a material having a high co-efficient of expansion. In one preferred embodiment of the invention, an enlongated expansion element in the form of a straight rod is utilized. One end of the rod is held fixed with respect to a housing of the heater while the opposite end is free. In a preferred embodiment of the invention, linkage means may be operatively engaged with the free end for multiplying motion in the free end. Expansion detection means, such as mechanical or magnetic switches, differential transformers or optical levers, are connected to the linkage means for activation by movement of the linkage means. In this way, when a temperature indicative of a hot spot is experienced by the rod, for example, in an embodiment which employs a rod linkage means and switch means, the rod expands to activate the switch means either directly or through the linkage means. In a manner not forming a part of the subject matter of the present application, the expansion detecting means may be connected to an alarm mechanism for indicating the presence of the hot spot to an operator.

Forms of expansion elements other than a rod, which may be utilized, include a bar, tube or wire. In order to avoid buckling, the expansion element can be preloaded via springs, dead weights, or like means, which maintain the expansion element in tension.

By providing a separate expansion element in each matrix compartment, full coverage is possible even when the air heater is not in service. There is no need for electrical connections in the matrix and the use of multiple expansion elements provides greater sensitivity than a thermocouple grid.

The invention can be utilized either for a stationary or rotating matrix regenerative heater, and is easily retrofit into existing rotating matrix regenerative heaters. In stationary matrix heaters, expensive resistance sensing electrical circuitry can be replaced by inexpensive switches which are used according to the present invention.

In embodiments in which the expansion element comprises a plurality of rods, the rods are either fixed at their inner or outer radial ends with the linkage or expansion detection means, or both, provided at the opposite radial end. Providing movement multiplying linkage means allows the use of readily available switches.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
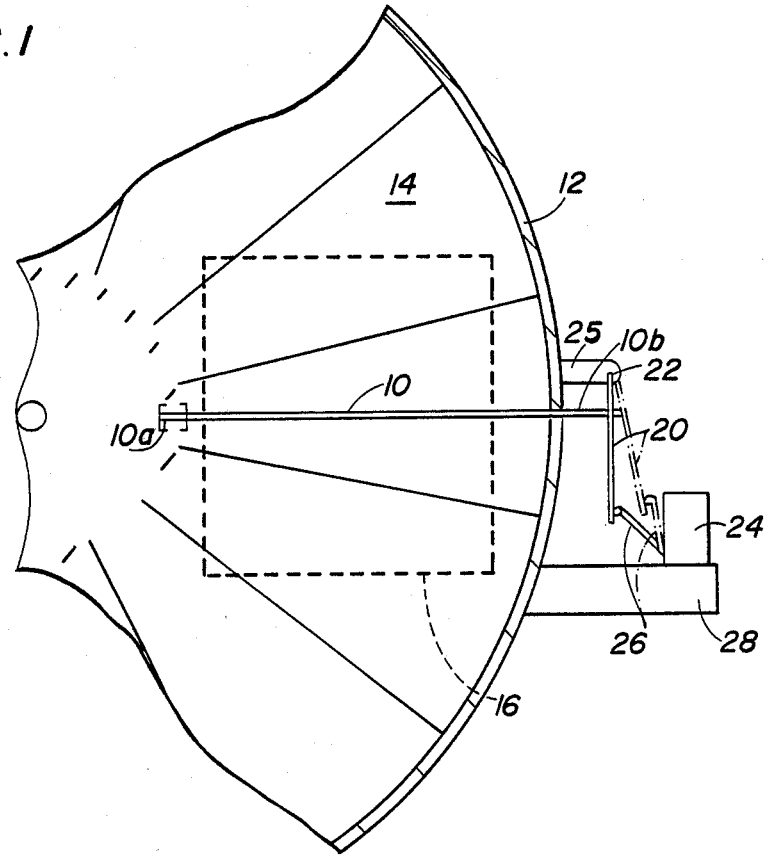
FIG. 1 is a schematic fragmentary radial sectional view of a regenerative air heater which may be of the stationary or rotary type and which includes the present invention.

Referring to the drawings in particular, the invention embodied in FIG. 1 comprises a hot spot detecting device comprising an elongated expansion element which, in the illustrated embodiment, is shown in the form of a straight rod 10 extending radially in a regenerative air heater housing 12 containing a multi-compartment heat exchanging matrix 14. Forms of expansion, other than a rod, which may be utilized, include a bar, tube or wire. In order to avoid buckling, the expansion element can be pre-loaded via springs, dead weights or like means which maintain the sensing element in tension. Hot gas passes into the housing through a duct 16, and passes the heat exchanging surfaces of matrix 14. The now heated matrix gives up its heat to a stream of air which also passes through housing 12 and past matrix 14. Heat is transferred between the gas and the air either by rotating the matrix or by rotating the connecting ducts for supplying either the air or the gas to the matrix. U.S. Pat. No. 3,183,961 shows an example of a regenerative air heater having a fixed matrix with a movable duct arrangement while U.S. Pat. No. 4,022,270 discloses a regenerative air heater having a rotating matrix and fixed ducts.

In the embodiment illustrated in FIG. 1, a radial inner end 10*a* of rod 10 is fixed with respect to housing 12 while its outer opposite end 10*b* is free for movement. When subjected to the heat of a hot spot, rod 10, which is advantageously made of metal or other material having a high co-efficient of expansion, relative to the housing structure, expands, causing its outer free end 10*b* to move with respect to housing 12. It is possible to increase the extent of this movement using linkage means in the form of a motion multiplying lever 20 or by other means connected to or engaged against the free end 10*b* of rod 10. One end of lever 20 is pivotally connected at a pivot point 22 to a support 24 fixed to housing 12. Free end 10*b* of rod 10 is advantageously engaged with lever 20 near pivot point 22. The opposite end of lever 20 is engaged with the activating arm 26 of a switch 24 which may, for example, be a microswitch. Switch 24 is advantageously connected to an alarm or other mechanism (not shown) for indicating the presence of the hot spot in the matrix 14. Switch 24 can conveniently be fixed with respect to housing 22 by a support 28. The phantom line position of lever 20 and switch arm 26 is reached when rod 10 has expanded after being exposed to a hot spot.

Figure 2:
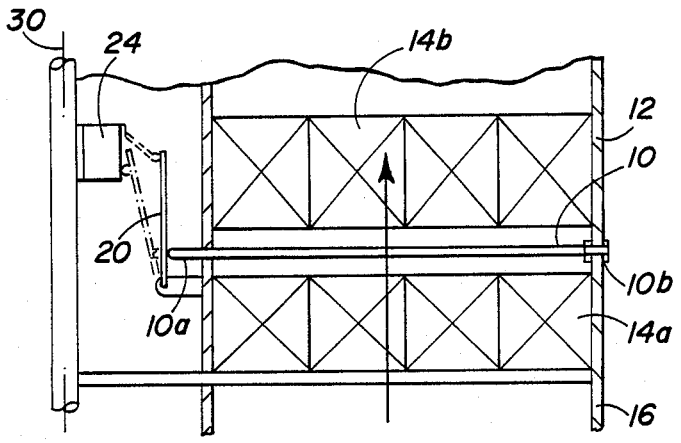
FIG. 2 is a schematic fragmentary longitudinal sectional view of a regenerative air heater embodying the present invention.

The embodiment of FIG. 2, where the same reference numerals are used to designate the same or similar parts, shows rod 10 having its outer end 10*b* fixed to housing 12 and its inner end 10*a* free for expansion. Motion multiplying linkage means in the form of lever 20 and switch means in the form of switch 24 are provided near the central axis 30 of housing 12 which, as in the embodiment of FIG. 1, may be a stator or rotor shaft. Matrix 14 is shown divided into a cold basket of heat transfer surfaces 14*a* and a hot basket of heat transfer surfaces 14*b*. For a rotating matrix, rod 10 may be positioned radially across housing 12 between the baskets. Additional rods may also be provided circumferentially around the matrix to service each compartment of the matrix.

In this way, the entire volume of the matrix is simultaneously screened for hot spots.

Figure 3:
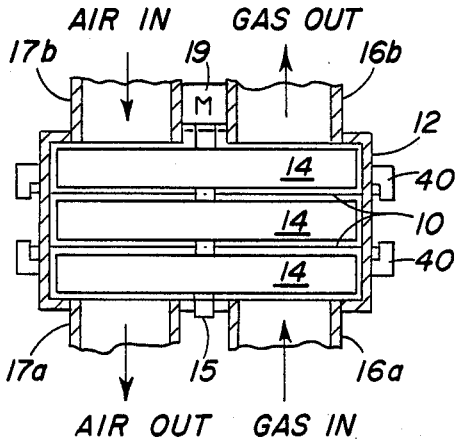
FIG. 3 is a schematic longitudinal sectional view of a rotary matrix regenerative air heater utilizing the present invention.

FIG. 3 shows an example of a rotary matrix regenerative heat exchanger having a housing 12 containing a matrix 14. A shaft 15 carries the various parts of matrix 14 and is rotated by a motor 19. Hot gases are supplied through an inlet duct 16*a* and past the matrix 14. The gases exit housing 12 through an outlet duct 16*b*. As the heated portions of the matrix slowly rotate in housing 12, they alternately pass through the air stream which is supplied by an inlet duct 17*b* and, the gas stream which is supplied by inlet blue 16*a* can be the source of the combustible material which can deposit on the matrix 14. Expansion element rods 10 are shown radially extending and longitudinally spaced along housing 12. The free outer end of each rod is serviced by a linkage plus switch mechanism collectively shown at 40.

Figure 4:
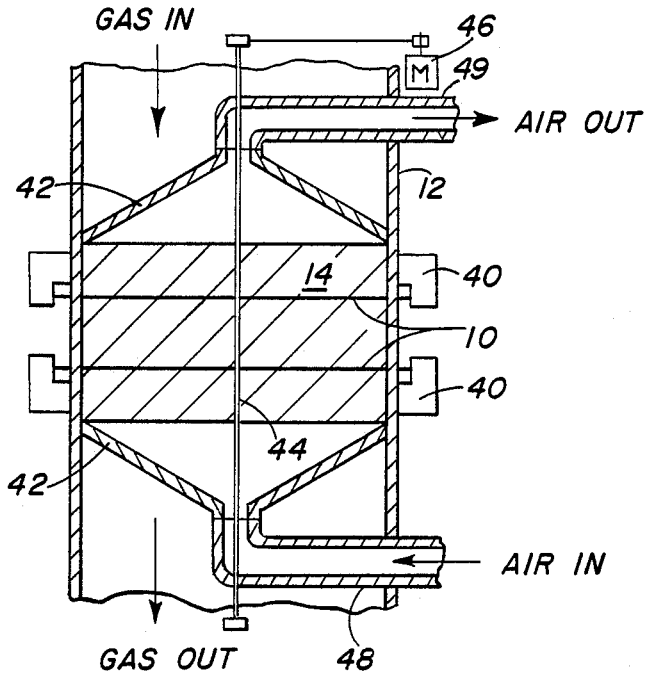
FIG. 4 is a view similar to FIG. 3 of a stationary matrix air heater utilizing the present invention.

FIG. 4 shows the example of a regenerative air heater having a fixed matrix 14 in a housing 12 which receives and discharges gases. Hoods 42 covering approximately half the heating surface matrix 14, mounted on a shaft 44 are rotated by a motor 46. Air or flue gas may blow through the hoods 42 and outside of the hood 42, and through that portion of the matrix 14 not covered by hoods.

Again, rods 10 extend radially in matrix 14 and are spaced longitudinally along the matrix. Each is serviced by its own combined lever plus switch means 40.

The material for rod 10 is selected to have a high co-efficient of expansion relative to the housing structure. A high co-efficient of expansion is desirable to increase the sensitivity.

This amount of expansion is enough to activate a switch, if multiplied by a simple lever arrangement, as shown in FIGS. 1 and 2. More complex lever arrangements can be utilized, however, to further multiply the motion of the free end of the rod, whether it is the free inner radial end or the free outer radial end.

Rod 10 may be solid and cylindrical in cross-section or have any other elongated shape.

As noted, the elongated expansion element of the invention can take the form of a rod, a bar, a tube or even a wire. In order to avoid buckling, it is possible to pre-load the expansion element by utilizing springs, dead weights or other mechanical means so that the element is pre-tensioned and remains in tension. FIGS. 5 through 9 schematically illustrate such arrangements.

Figure 5:
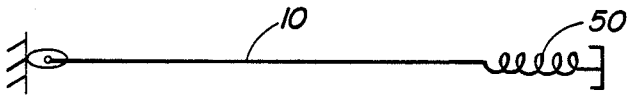
FIG. 5 is a schematic illustration of an arrangement for tensioning an expansion element of the invention.
Figure 6:
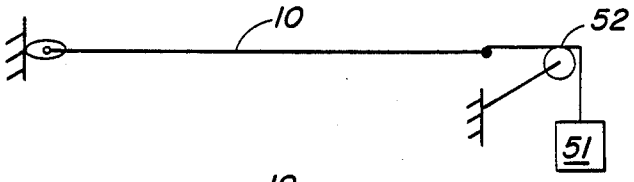
FIG. 6 schematically illustrates an alternate means for tensioning an expansion element according to the invention.
Figure 7:
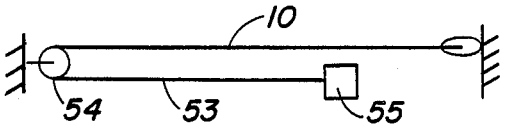
FIG. 7 schematically illustrates still a further alternate means for tensioning an expansion element according to the invention.
Figure 8:
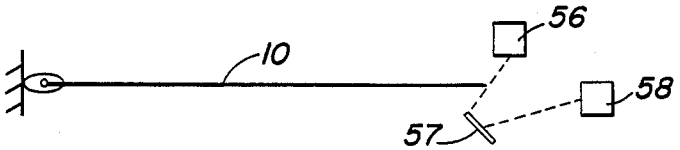
FIG. 8 illustrates optical means for detecting expansion of the expansion element.
Figure 9:
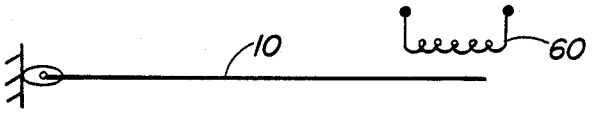
FIG. 9 illustrates an electrical means for detecting expansion of the expansion element.

In FIG. 5, the free end of expansion element 10 is pre-tensioned via a spring 50. In FIG. 6, a weight 51 is attached to the free end of element 10 and mounted over a pulley 52 in such a way as to pre-load the element 10 by gravity. FIG. 7 schematically illustrates a pulling means 53, such as a wire cable, connected to the free end of element 10 and mounted over a pulley 54 to pre-tension the element via a conventional pulling means 55. FIG. 8 illustrates the use of a light source 56, a mirror 57 and photocells 58, to detect elongation of the expansion element 10. FIG. 9 schematically illustrates a differential transformer 60 mounted proximate to the free end of the expansion element 10 to detect elongation thereof.

In operation, both the structure containing the heating surface and the elongated expansion element will expand when the air heater is in service. The expansion element will expand a greater amount than the structure. In the event of a local hot spot, the expansion element will increase in length by amount proportional to the increase in local temperature and the length over which the local heating occurs. The air heater structure is so stiff that local heating will not result in additional thermal expansion compared to the expansion element which is free to grow in one direction.

Expansion element material having a high co-efficient of expansion is desirable to maximize the sensitivity. Due to relatively higher cost, it may be desirable to use an element having thinner section, such as a wire, but this can lead to buckling if there is any binding or other friction in the mechanism. It is preferable, therefore, to use a spring or other means to maintain tension in the element.

While specific embodiments of the invention have been showed and described in detail to illustrate the application of the principles of the invention, it will be understood that the invention may be embodied otherwise without departing from such principles.

The invention claimed is:

1. In combination with a regenerative air heater having a housing, a matrix in the housing and means for supplying, through the housing, air to be heated by the matrix, and gas to heat the matrix, a device for detecting a hot spot in the matrix comprising at least one elongated expansion element made of material having a high co-efficient of expansion, said expansion element extending through the matrix and having one end fixed with respect to the housing and an opposite free end, whereby said expansion element is expandable in length upon being exposed to a hot spot in the matrix, and means for detecting expansion of the length of the elongated expansion means.

2. The combination of claim 1, wherein the elongated expansion element comprises a rod.

3. The combination of claim 2, wherein the housing has a central axis and an outer wall, said rod extending radially between said axis and said wall.

4. The combination according to claim 3, wherein an inner radial end of said rod is fixed with respect to the housing.

5. The combination according to claim 3, wherein an outer radial end of said rod is fixed with respect to the housing.

6. The combination according to claim 3, wherein the matrix is mounted for rotation in the housing, the matrix having a plurality of spaced parts, the rod extending between at least two of said spaced parts.

7. The combination of claim 3, wherein the matrix is fixed with respect to the housing, the regenerative air heater including movable duct means for supplying one of air and gas through the matrix.

8. The combination of claim 2, wherein the expansion detecting means includes motion multiplying linkage means operatively engaged with the free end of said rod for movement with expansion of said rod.

9. The combination according to claim 8, wherein said linkage means comprises a lever pivotally mounted at one end thereof to the housing, said lever being engaged with said switch means at an opposite end of said lever.

10. The combination of claim 9, wherein said free end of said rod engages against said lever near said pivotally mounted end of said lever.

11. The combination of claim 10, wherein the expansion detecting means includes means for activating said linkage means responsive to the expansion of the length of the rod.

12. The combination of claim 11, wherein said activating means comprises switch means operatively engaged with the linkage means.

13. The combination according to claim 12, wherein said switch means comprises a switch having an activating arm engaged against the opposite end of said lever.

14. The combination of claim 1, wherein the elongated expansion element comprises a bar.

15. The combination of claim 1, wherein the elongated expansion element comprises a tube.

16. The combination of claim 1, wherein the elongated expansion element comprises a wire.

17. The combination of claim 1, further comprising means for pre-tensioning the elongated expansion element.

* * * * *